US005878688A

United States Patent [19]

Merrett et al.

[11] Patent Number: 5,878,688

[45] Date of Patent: Mar. 9, 1999

[54] KICK BOAT

[75] Inventors: John B. Merrett; Randell B. Heath, both of Morgan, Utah

[73] Assignee: Outdoor Engineering, Inc., Morgan, Utah

[21] Appl. No.: 609,736

[22] Filed: Mar. 1, 1996

[51] Int. Cl.[6] ..... B63B 7/00

[52] U.S. Cl. ..... 114/354; 114/345

[58] Field of Search ..... 114/352–354, 61, 114/345, 283, 123, 363; 440/27–30; 441/129–131, 125

[56] References Cited

U.S. PATENT DOCUMENTS

| | | | |
|---|---|---|---|
| 2,010,371 | 8/1935 | Perri | 441/130 |
| 3,473,502 | 10/1969 | Wittkamp | 114/345 |
| 3,981,259 | 9/1976 | Harper, Jr. | 114/61 |
| 5,011,441 | 4/1991 | Foley et al. | 440/30 |
| 5,174,232 | 12/1992 | Boddy | 114/345 |
| 5,290,196 | 3/1994 | Steel | 441/130 |

FOREIGN PATENT DOCUMENTS

| | | | |
|---|---|---|---|
| 2010369 | 9/1970 | Germany | 114/345 |

*Primary Examiner*—Ed L. Swinehart
*Attorney, Agent, or Firm*—Trask, Britt & Rossa

[57] ABSTRACT

A kick boat employing a hinged frame design provides an infinitely adjustable foot rest and leg support, and infinitely adjustable mainframe positioning. No tools are required to assemble and disassemble the boat. The hinged frame is structured and arranged to collapse and partially rotate to form a back pack frame. Alternatively, the hinged frame may be fully rotated to a fully collapsed space minimizing storage position. A cargo bay restraining system is also provided.

35 Claims, 6 Drawing Sheets

KICK BOAT

BACKGROUND OF THE INVENTION

1. Field

This invention relates to single user water craft. More specifically, the invention is directed to kick boats, and provides several enhancements for such boats.

2. State of the Art

Typically, kick boats are single person vessels which are powered by the action of swim fins on the user's feet or of oars supported on the framework of the vessel. Small motors may also be used on these boats. Kick boats are popularly used as fishing platforms, but they are also used more generally for water transport, such as in connection with hunting, touring or white water rafting.

These boats generally comprise two inflatable cylindrical pontoons harnessed together by means of a rigid mainframe. The mainframe functions as the support for seating or decking, and also serves as the attachment point for any optional equipment; such as foot rests, frame extensions, motors, oars, rod holders, beverage holders, fish finders, stripping aprons, cargo containers, anchors, etc.

Mainframes have typically been constructed of aluminum. In general practice, assembly of the mainframe to the pontoons requires that the mainframe rest directly on the pontoon surfaces. Significant problems have been associated with such direct contact between the mainframe and pontoons. Friction between the surfaces of a pontoon and a frame during use of the boat causes black oxide to rub off of the mainframe and stain the pontoons and anything else coming in contact with the oxide. Aluminum mainframes also are easily scratched and dented during use, transportation and storage. Pontoon surfaces are subject to puncture and abrasion, because of the conventional materials of construction of the pontoons, typically PVC, rubber, rubberized fabric or similar polymeric materials. Raised or rough areas on the mainframe cause cuts and abraded areas in the pontoon surfaces. To avoid staining, puncture and abrasion problems, boat owners must invest considerable time in maintaining the boat. The aluminum frame must be kept painted to avoid any direct surface contact between the mainframe and the pontoons; and any dents or nicks must be smoothed out before the mainframe can be attached to the pontoons.

Historically, kick boats have been designed with wrap around mainframes supported on a pair of inflatable pontoons. The mainframe harnesses the pontoons in spaced tandem arrangement. The major portion of the frame is thus suspended between the pontoons as a support structure having side members, front and rear cross members and a central platform. Any additional boat components and accessories are attached to this support structure.

The bending moments generated in conventional mainframes have been observed to have a negative impact on the durability of the frame. The largest bending moments generated in the mainframe occur where the side members are joined to the central platform. Breakage often occurs in this area, especially under conditions causing the pontoons to bounce or the load to fluctuate (in rough water, for example). Overstress failures have also been observed to occur in the regions where foot rest and cargo bay accessories are attached to a frame.

Conventional mainframes are tubular in construction to reduce weight. Cargo platforms are generally attached to a mainframe by sliding reduced cross section segments carried at the ends of a tubular cargo frame into tubular mainframe members. Cargo frames have historically been constructed of tube material having the same inner and outer diameters as the associated mainframes. A reduced cross section segment at the end of the cargo frame therefore act as a stress riser which weakens the cargo frame. Failure of the cargo frame due to this stress riser has been observed.

Cargo platforms comprising soft floors, such as those constructed from textile mesh or canvas, for example, stretched across a rigid frame are typically attached to the back end of the mainframe to carry any gear a boater may need to transport. Such soft floors have been favored because they offer considerable weight savings over the use of a solid platform. Unfortunately, the textile materials of construction tend to sag when loaded, so that gear is immersed in the water to some degree while the boat is in use.

Accessories are typically attached to side members of a mainframe, to be convenient to a boater's hand during boating. Unfortunately, any strap used to attach an accessory to a side member of the mainframe is inherently pushed into the pontoon surfaces when a mainframe is mounted on the pontoons. Other fastener systems and accessory surfaces moving against the pontoons also cause problems associated with wear. Vibration due to wind or rough water, or the transport of an assembled boat, causes abrasion of the pontoon surfaces under these pressure points.

Another commonly used method used to attach accessories to the mainframe side members is to fasten or integrally form a clevis at one end of the accessory. The clevis slips over a side member and is fixed in place. Oar locks, fishing rod holders, and beverage holders are examples of accessories that may be attached to a mainframe in this manner. Conventionally, clevis and side members have been made of aluminum. Galling between the clevis and side member surfaces has been found to present a significant problem after short usage times.

Wrap around mainframes provide stability along the full length of each pontoon and maintain the pontoon pair in parallel position even in relatively rough water conditions. Unfortunately, the front cross member of a conventional wrap around design obstructs a user's entry and exit from the vessel. This problem increases with increasing water depth. Historically, the front cross member of a mainframe has acted as a footrest. A footrest provides many practical advantages; for example, for generally relaxing, for resting and stretching finning muscles, or for supporting a user's feet in an elevated position to clear bottom hazards. It also may serve as a foot brace for more efficient rowing action.

A framing system which eliminates front cross members offers convenient walk-in access to the vessel's seating area, but with the accompanying loss of the footrest. "L"-shaped foot rest extensions have thus been attached to the side members of certain mainframes lacking a front cross member. Neither the conventional front cross member nor the newer foot rest extension is continuously adjustable to comfortably accommodate various leg lengths.

It is recognized that it would be beneficial to provide adequate leg support above the surface of a kick boat's foot rest. Such leg support would be expected to alleviate leg strain when the feet are elevated. Hypothetically, a cross member could provide additional leg support with the use of a foot rest attachment suspended from and located forward of the member, but only if the user's legs, through serendipity, happened to be of the correct length to take advantage of such a feature.

The front cross member has also historically acted as a tether. It is often advantageous (when fishing in rivers, streams and lake shallows for example) to stand up intermittently during the use of a kick boat. When a boater stands, the boat continues to be acted upon by any wind or current present. Removal of the front cross member of wrap around mainframes leaves a gap in the structure surrounding a user, thereby allowing the boat to drift free under these circumstances.

Stripping aprons are commonly used in conjunction with kick boats to catch and contain fly fishing line as it is stripped back after casting. The apron may also be used as a work surface for other applications. Conventional aprons represent a safety hazard as they present a physical barrier to egress from the craft, should the craft over balance.

Conventional aprons are also fixed in place and are not adjustable to accommodate boaters of various sizes. Any gap between the apron and a boater will allow stripped line to fall out of the boat. Wet line sinks in the water, so any line falling into the water in front of a boater becomes entangled around the boater's legs and swim fins or around rocks and weeds. Under sized aprons present the same problem. A full sized apron that could be adjustably positioned along the longitudinal axis of the boat would constitute a significant improvement.

When deployed, conventional stripping aprons interfere with easy access to the seating area of a boat, just as the front cross members of wrap around mainframes do. A user typically must choose between attaching a stripping apron to a boat, thereby restricting access to the seating area, or stowing it away in a cargo container. It would be more convenient to be able to easily access the seating area without disassembling the apron. A storage system that keeps the apron handy and easily deployed, but out of the way when not in use, would be an additional enhancement.

Many kick boat accessories are available to enhance user comfort and convenience. Historically, it has been difficult to attach accessories to the mainframe in a manner avoiding entanglement of the boater or abrasion of the pontoons, and to avoid clutter, while allowing the accessory to be easily accessed when wanted. Historically, accessories are provided to serve a single function. It would be of benefit to provide adaptable accessories that can meet a variety of needs, to eliminate clutter.

Conventional boat models are provided with the aim of meeting the needs of boaters primarily interested in one particular type of application. Boats configured for lake fishing are not necessarily convenient for river fishing or river running for example. A versatile boat that can be configured to meet a variety of needs would be highly advantageous.

Storage of kick boats has been inconvenient for those, such as apartment dwellers, having limited storage space. Kick boats have generally been bulky, even when disassembled for storage or transport. Duffle bags and bags with attached back pack straps have been used to increase kick boat portability. The bag size (approximately 4 feet long) required to contain a basic kick boat is awkward to carry when hiking to water.

Conventional kick boat designs utilize metal-to-metal (usually aluminum-to-aluminum) joints. Tools are required to assemble and disassemble these conventional kick boat joints. Screw drivers and socket and crescent wrenches are examples of the tools commonly required. Most conventional joint assembly methods for kick boats require nuts, bolts and washers. Some joints (such as for the attachment of oar locks or cargo frames) also require the use of a mallet to assist in their assembly. Mallets are required as the metal becomes substantially galled due to the rocking motion of the vessel on water. Such tools add to the weight that must be transported with the vessel. When boating, there is always the danger of loosing tools and fasteners in the water.

The cylindrical pontoons of kick boats have conventionally presented substantial flat water line interfaces. Flat interfaces on the pontoons provide enhanced tracking but decreased maneuverability of the vessel. A flat interface also provides a large frictional resistance surface in contact with the water when water flows perpendicular to the flat interface.

Newly developed swept pontoons are being offered to replace the previously favored cylindrical pontoons in some applications. When viewed in a longitudinal cross section, cylindrical pontoons have parallel walls over the water contact area, that rest flat on the water. Swept pontoons may include a cylindrical midsection, but are otherwise characterized by converging walls that curve up away from the plane of the water surface. Fully swept pontoons have no cylindrical sections and are offered with varying radii of curvature.

Swept pontoons greatly decrease the water resistance of the boats and allow for greater maneuverability and easy propulsion action. However, boats utilizing swept pontoons are less stable in the water and so are less forgiving of longitudinal load imbalances. Therefore, there is an increased need for adjustability in situating the mainframe longitudinally along the pontoons, to balance the load carried by the pontoons.

There remains a need for a versatile kick boat with adjustable and secure foot, leg and seat support structures, improved cargo storage, and reduced maintenance requirements. There further remains a need for a kick boat assembly capable of more efficient storage and transport, and for a safe, durable, and collapsible design that provides rigid stability when reassembled. There is also a need for improved load balancing capabilities for swept pontoon kick boats. Elimination of the need for tools and loose hardware for assembly and disassembly would eliminate a major source of inconvenience, and would help reduce weight, thereby enhancing portability. Improved accessory storage and an adjustable and safe stripping apron are also needed.

SUMMARY OF THE INVENTION

The present invention is an improved full size kick boat requiring no tools to assemble and disassemble. Fasteners which can be permanently mounted to the mainframe may be provided. The invention employs a hinged frame structure which allows for efficient break down, space saving storage, and easy transportation. The hinged frame also provides stress reduction in the frame, and therefore increases the durability of a boat. A better cargo storage system is obtained by utilizing snap hooks in combination with the improved fastener system. A safe, full sized stripping apron and other improved accessory systems may be included. The invention also provides infinitely adjustable foot rests and leg supports; and infinitely adjustable mainframe positioning for enhanced load balancing capabilities. Maintenance requirements and potential damage to the pontoons from the mainframe and attached accessories are measurably reduced as a result of isolating the mainframe from the pontoons.

This invention provides kick boats of generally known construction. That is, they have forward and aft ends, a longitudinal axis, a pair of elongated pontoons oriented approximately parallel the longitudinal axis. A support structure is mounted to the pontoons through means structured and arranged to hold the pontoons in spaced parallel arrangement, with a central platform of the support structure between the pontoons to provide support for a load. The invention utilizes a novel connection system for mounting the support structure to the pontoons, however.

The mounting system of this invention comprises a plurality of saddle structures, each configured to distribute load across a substantial area of the upper surface of a pontoon. By "substantial" is meant a contact area several times greater than that provided by construction tubing itself. At least one such saddle structure is positioned atop each pontoon. The system also utilizes flexible linkage structure connecting each saddle structure to the central platform. The relative positions of the pontoons with respect to the platform are thus permitted to adjust in response to forces acting upon the pontoons, or in the absence of pontoons, the saddles themselves. Forces acting on the pontoons may be either direct or reactive in nature. The flexible linkage structure typically includes a hinge assembly comprising a tubular deck frame hinge member with a central axis approximately parallel the longitudinal axis of the boat and positioned inboard a pontoon in mounted condition. The deck frame hinge member has an open terminal end. A tubular saddle hinge member is positioned with a first open terminal end juxtaposed to the terminal end of the deck frame hinge member at a pivot plane such that a central axis of the saddle hinge member is approximately congruent with the central axis of the deck frame member. A pin structure is placed to extend through the pivot plane to register with the interiors of the deck frame hinge member and the saddle hinge member, whereby to permit pivoting movement at the plane. In some cases, the hinge assembly further includes a tubular bushing inserted through the hollow interiors of the deck frame hinge member and the saddle hinge member. The hinge pin is then inserted through the hollow interior of the tubular bushing.

A typical support structure of the invention comprises a mainframe having first and second side members parallel the longitudinal axis of the boat. First and second saddle assemblies extend from connection to the mainframe. Each such assembly includes a saddle structure and lock down mechanisms by which the pontoons are firmly attached through the saddles to the mainframe, such that the pontoons are held approximately parallel each other and parallel the longitudinal axis of the boat. A deck frame assembly is located between and affixed to the saddle assemblies, the deck frame serving as a rigid spacer between the saddle assemblies.

A deck frame assembly comprises a platform and first and second side members. Each of the side members connects to a respective flexible linkage structure. The saddle assemblies are structured and arranged to permit pivotal movement from their normal mounted position through approximately 180 degrees around the hinge pins to a stacked collapsed arrangement atop the deck frame assembly. The saddle assemblies are ideally configured to form, together with the deck frame assembly, a back pack frame when the saddle assemblies are pivoted partially towards the stacked collapsed arrangement.

A preferred embodiment includes a mainframe having first and second side members approximately parallel the longitudinal axis of the boat, transverse support structure connecting the first and second side members and a seating area forward of the transverse support structure. It further includes first and second foot rest assemblies, each having a foot support portion carried at the distal end of and approximately transverse a longitudinal support member. The longitudinal support members of each foot rest assembly may be connected to the mainframe through respective adjustable mounting mechanisms structured and arranged to provide an adjustable distance between the foot supports and the seating area. The adjustable mounting mechanisms may also be structured and arranged to permit adjustment of rotational attitude with respect to horizontal of each the foot support. "Horizontal," in this context refers to an imaginary plane approximately parallel the earth's surface. Each longitudinal support is preferably configured to provide support to the leg of an individual seated on the seating area with the foot of the individual positioned against the foot support.

Ideally, the adjustable mounting mechanism comprises a tubular collet assembly mounted on the mainframe. The collet assembly is selectively adjustable between loosened and tightened conditions. The effective, or cantilevered, length of the longitudinal support members are adjusted by sliding them within the collet assembly and the rotational attitude of the foot rests are adjusted by rotating the longitudinal support members within the collet assembly. A collet assembly may be mounted to a second open terminal end of a saddle hinge member such that the longitudinal support member of a foot rest assembly may be inserted through a hollow pin structure into the interiors of the saddle hinge member and the deck frame hinge member.

An assembly consisting of two pontoons and a mainframe constitute a working kick boat of this invention. Such an assembly is referred to as a basic boat, and may be the preferred configuration for certain applications. The basic boat configuration may be preferred when using the boat as a swim or diving platform, or when back packing the boat for substantial distances, for example.

Various and multiple accessories may be attached to the mainframe to enhance boater comfort and expand the boat's versatility. Most commonly, a seat is added to the basic boat. A cargo bay, an oar assembly, and a foot rest system are also common accessories. Additional accessories may include: an anchor system, saddle bags, a fish finder assembly, a motor assembly, and a stripping apron. Other accessories such as beverage holders, bait boxes, fish creels and stringers, camouflage, and storage pouches and bags, among others, are also easily accommodated.

Improvements in cargo bay, stripping apron, anchor assembly, oar assembly, rod holder, seating mechanism and foot rest system accessories are provided by this invention. An improved kick boat assembly method is also provided. These improved accessories and assembly method may be used in combination with the hinged mainframe of this invention, or may be used with other mainframe configurations.

Certain embodiments of this invention mount a hinged frame on a pair of swept pontoons. Other embodiments mount a hinged frame on a pair of cylindrical pontoons. A hinged frame of this invention may be used interchangeably with various pontoon configurations, depending on the intended usage of the boat. The relatively flat water line interface provided by cylindrical pontoons may be preferred when shooting from a kick boat used as a hunting platform or fishing in a windy area. The improved maneuverability provided by swept (curved) pontoons may be preferred when running through white water or around obstacles, for example.

In a preferred embodiment of this invention, the hinged frame removes from the pontoons and fully collapses to fit into a small storage space. A specific example of such a frame may be collapsed into a storage space measuring approximately 22"×26"×9". In contrast, conventional frames, even for smaller sized boats, require a storage space measuring approximately 48"×24"×9".

Alternatively, the frame may be collapsed to form a rigid structure the size of, and suitable for use as, a conventional back pack. Back pack straps are attached to the collapsed frame, and a suitably sized sack is suspended within. When the pontoons are deflated, all of the basic kick boat components fit inside the suspended boat sack with room remaining for optional equipment such as waders, swim fins, and rod holders. Chest and hip straps may also be attached to the collapsed frame to improve the comfort and fit of the collapsed boat frame when worn as a back pack.

An adjustable foot rest system of this invention allows infinite longitudinal adjustment to accommodate varying leg lengths, and also infinite rotational adjustment for boater comfort and to provide a stowed position allowing unrestricted access to the front of the boat. A foot rest locking feature provides a means for mounting a foot rest in a permanently marked position calibrated to a primary boater. The locking feature also provides a means of securing the foot rest in any position, even through very large temperature swings and under heavy loads (i.e.: oar powered river running).

BRIEF DESCRIPTION OF THE DRAWINGS

In the drawings, which illustrate what is presently regarded as the best mode for carrying out the invention.

DETAILED DESCRIPTION OF THE ILLUSTRATED EMBODIMENTS

Figure 1:
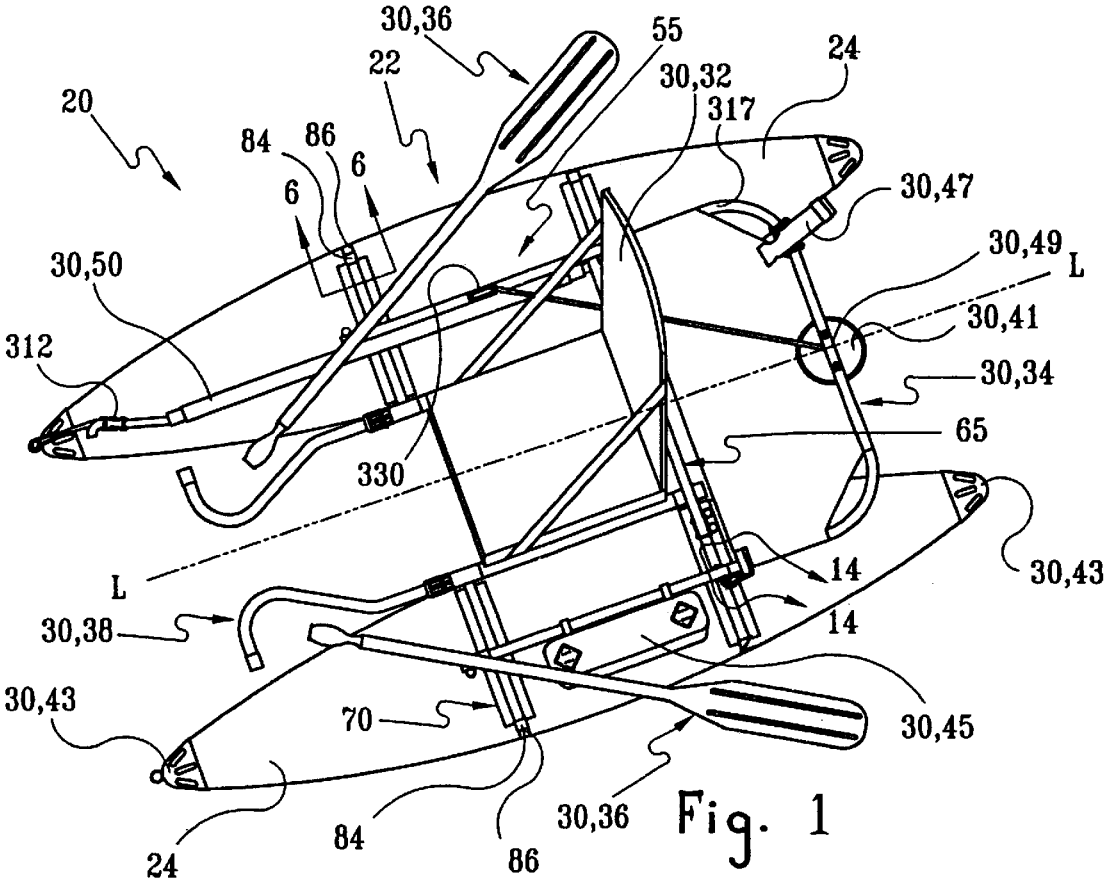
FIG. 1 is a pictorial view of a first embodiment of a kick boat of the present invention.

As illustrated, an improved kick boat, generally 20, as best shown in FIG. 1, is constructed of a mainframe, generally 22, made buoyant through the support of a pontoon 24 on each side. In this basic boat assembly, the mainframe 22 retains the pontoons 24 in an orientation parallel to each other and to the longitudinal axis L—L of the boat 20. Each pontoon 24 also has a longitudinal axis L'—L' (FIG. 3) which is parallel to the longitudinal axis L—L of the boat 20.

As shown in FIG. 1, many accessories, generally 30, may be attached to the mainframe 22 to enhance boater comfort and expand the boat's versatility. Most commonly, a seat 32 is added to the basic boat. A cargo bay 34, an oar assembly 36, and a foot rest system 38 are also common accessories. Additional accessories may include: an anchor system 41, nose cones 43, saddle bags 45, a fish finder assembly 47, a motor assembly (represented by motor mount 49) and a stripping apron assembly 50. Other accessories are also easily accommodated and within contemplation of this invention.

Figure 2:
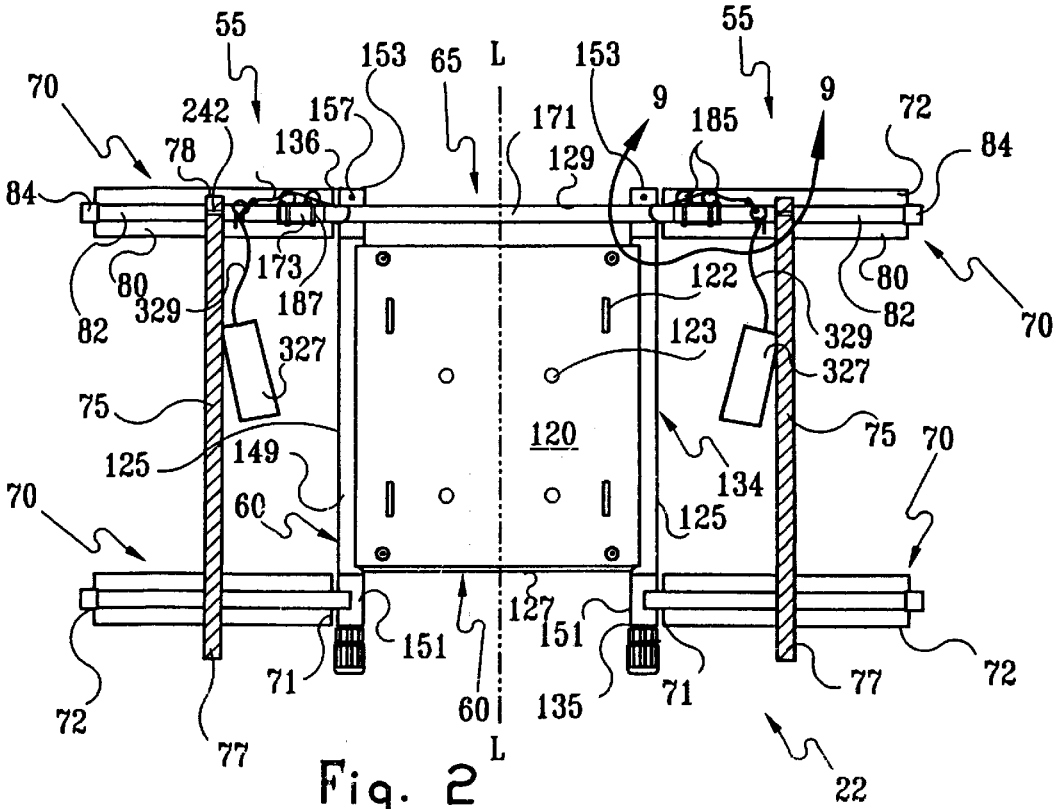
FIG. 2 is a plan view, partly in cross section, of a kick boat mainframe of this invention, with a strut and seat platform attached.

The mainframe 22 (most clearly illustrated in FIGS. 2 and 3) consists of two saddle assemblies 55 attached to a deck support structure 60 and stabilized by a saddle restraint mechanism, generally 65, FIG. 2. Each saddle assembly 55 is fastened to a respective side of the deck support structure 60 and cradles one of the pontoons 24. The deck support 60 functions as a rigid spacing member between the pontoons 24.

As illustrated, a saddle assembly 55 is composed of two saddles 70, each having an inner end 71 and an outer end 72. Two saddles 70 are oriented transverse to each pontoon's 24 longitudinal axis L'—L', each saddle 70 pair being spaced apart parallel to the longitudinal axis L—L of the boat. A rigid rail 75, having a front end 77 and a back end 78, joins each pair of saddles 70 together in fixed tandem arrangement in each saddle assembly 55. In the illustrated embodiment a rail 77 is attached to the tops of the pair of saddles 70 to ensure a space 79 is maintained between the rail 75 and the pontoon 24 surfaces. Each saddle 70 describes a ring generally concentric with the longitudinal axis L'—L' of a pontoon 24.

Figure 3:
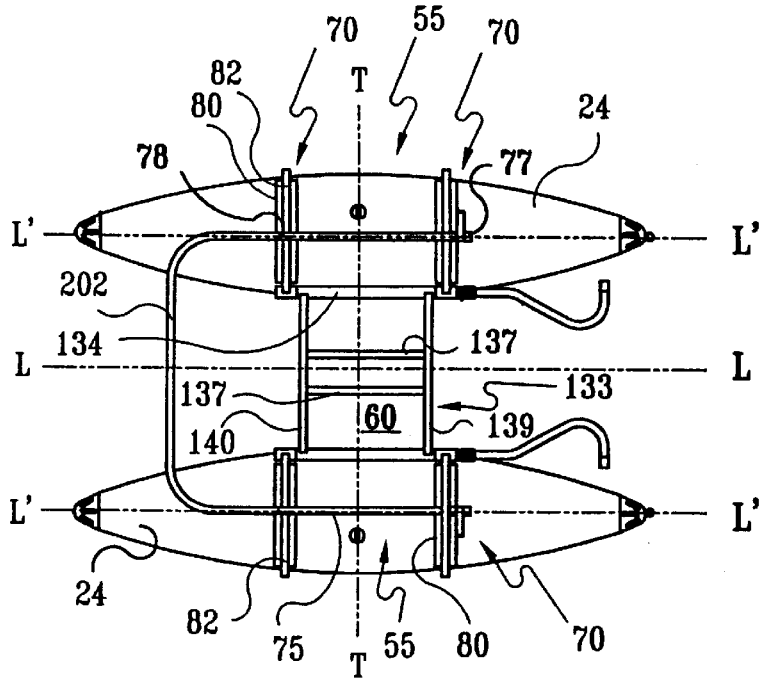
FIG. 3 is a plan view of a kick boat mainframe of this invention assembled to two swept pontoons, and with foot rest and cargo bay frame accessories attached.
Figure 4:
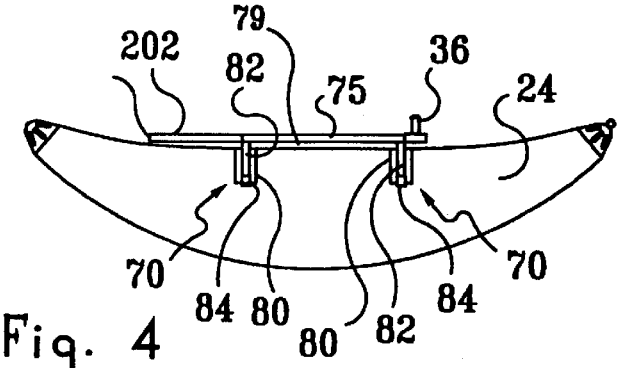
FIG. 4 is a side view in elevation of the embodiment illustrated in FIG. 3.
Figure 5:
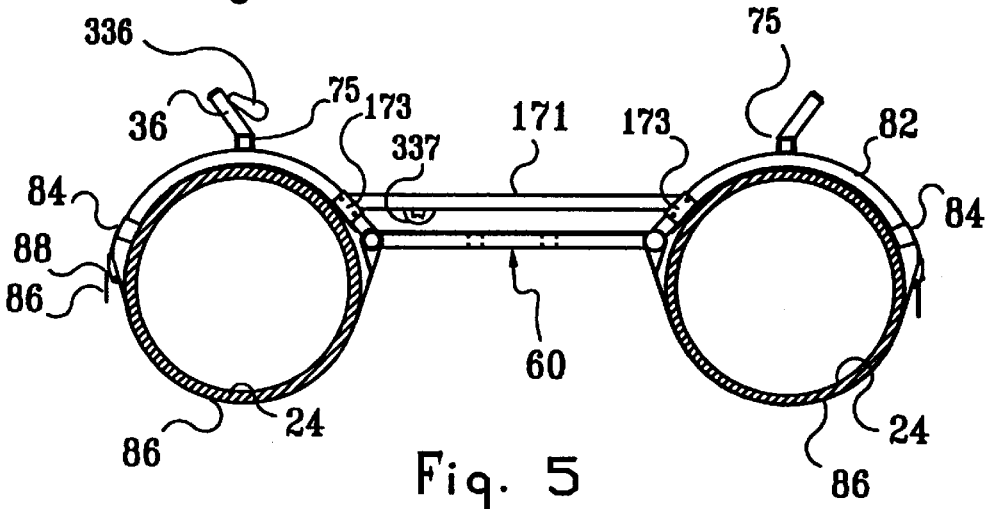
FIG. 5 is a front view in elevation, partially in phantom lines and partially in cross section, of the embodiment illustrated in FIG. 3.

The saddle 70 illustrated in FIGS. 2–6 consists of a saddle isolation unit 80, rigid saddle stiffener 82, end cap 84, pontoon strap 86, and strap cinching system 88 (FIG. 5). Saddle isolation unit 80 (FIG. 6) includes a saddle band 93, a saddle sleeve 95, and a surface treatment 97. The surface treatment 97 is optional, but is generally preferred to provide a non-slip gripping surface against each pontoon 24.

Figure 6:
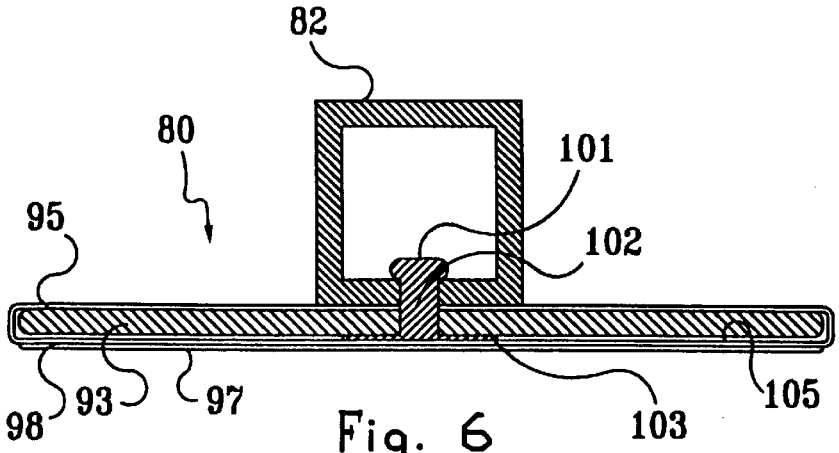
FIG. 6 is an enlarged cross sectional view of one embodiment of a frame isolation saddle assembly of the invention, taken along the section line 6—6 of FIG. 1, viewed in the direction of the arrows.

In FIG. 6, a saddle band 93 is shown enclosed in an isolation sleeve 95 and a surface treatment 97 is shown attached to the outer bottom surface 98 of the sleeve 95. The saddle band 93 and a saddle stiffener 82 are fastened together so that the full contact surface of the stiffener 82 rests on the saddle band 93. The saddle band 93 rests on the pontoon 24 surfaces. As illustrated in FIGS. 3–5, none of the saddle stiffener 82 surfaces come into contact with the pontoons 24. All contact between the mainframe 22 and the pontoons 24 occurs at the interface between the pontoons 24 and the saddle isolation unit 80.

In the embodiment shown in FIG. 6, the surface treatment 97 is sewn onto the outer bottom surface 98 of the sleeve 95. The saddle band 93 and a hollow saddle stiffener 82 are riveted together so that the rounded head 101 of the rivet 102 is inside the saddle stiffener 82; the body of the rivet passes through the saddle stiffener, the saddle sleeve 95 and the saddle band 93; and the flat bottom 103 of the rivet 102 is sandwiched between the saddle band 93 and the inner bottom surface 105 of the saddle sleeve 95. This construction eliminates sharp edges and shifting and sliding that might otherwise cause abrasion of the pontoons 24. It also eliminates aluminum rivet 102 surface contact with the pontoon 24 surface.

End caps 84 are fitted onto the saddle stiffeners 82 at the outer ends 72 of the saddles 70. Pontoon straps 86 are threaded through slots (not shown) in the end caps 84 and used to tightly cinch the saddles 70 against the pontoon 24 surfaces via a cinching system 88. For added security, the straps 86 may be fastened to the inside of the saddle stiffener 82, with a rivet and washers, for example.

The rail 75 is attached to the tops of the saddle stiffeners 82. Placement of the rails 75 on top of the stiffeners 82 ensures that the rails 75 do not ride directly on the pontoon 24 surfaces. It is a feature of a preferred embodiment of the present invention (one employing aluminum in manufacturing all of the required rigid structures of the mainframe 22), that no aluminum surfaces are allowed to come into contact with the pontoon 24 surfaces.

In FIG. 2, the deck support 60 carries a seat platform 120 which may be welded, riveted, bolted, or otherwise rigidly fastened to the deck support 60. An arrangement providing slits 122 through the thickness of the seat platform 120 which allows straps (not shown) attached to the bottom of a seat 32 to pass through the platform 120 and wrap around the deck support 60 is illustrated. Bolt holes 123 are also provided to accommodate alternate seats 32.

Figure 7:
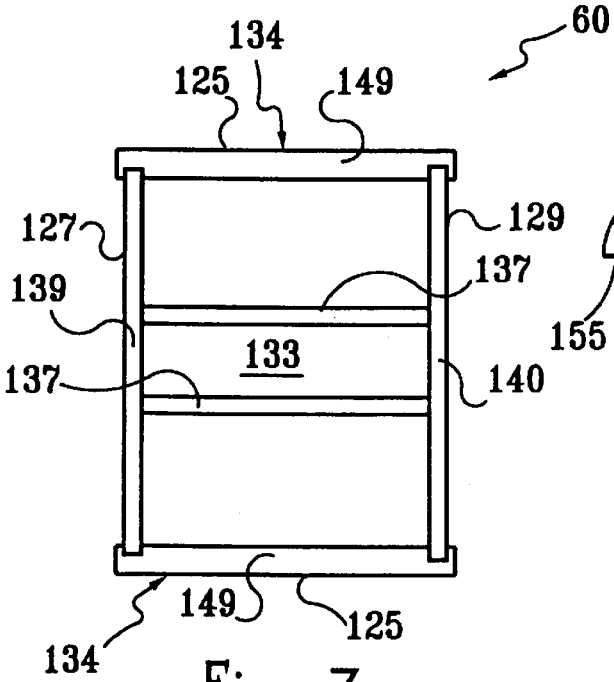
FIG. 7 is a plan view of an embodiment of a deck support of this invention.

Referring to FIGS. 3 and 7, one embodiment of a deck support 60 of the invention, having two side edges 125 and front 127 and back 129 edges, includes a rigid H-frame 133 and two rigid hinge assemblies 134. The hinge assemblies 134 have forward and back ends 135, 136 respectively. In the H-frame 133, two rigid longitudinal cross beams 137 are welded or otherwise rigidly fastened in spaced apart parallel orientation to parallel first 139 and second 140 rigid transverse cross beams. The transverse cross beams 139, 140 are, in turn, welded or otherwise rigidly fastened in spaced apart parallel position to the hinge assemblies 134. The terms inner cross beam and longitudinal cross beam are used interchangeably in the industry, as are the terms outer cross beam and transverse cross beam.

The transverse cross beams 139, 140 are attached at the outer ends of the lateral cross beams 137, and rigid hinge assemblies 134 are attached at the outer ends of the transverse cross beams 139. The first transverse cross beam 139 defines the front edge 127 of the H-frame and the second transverse cross beam 140 defines the back edge 129 of the H-frame. Hinge assemblies 134 define the sides of the deck support 60.

Figure 8:
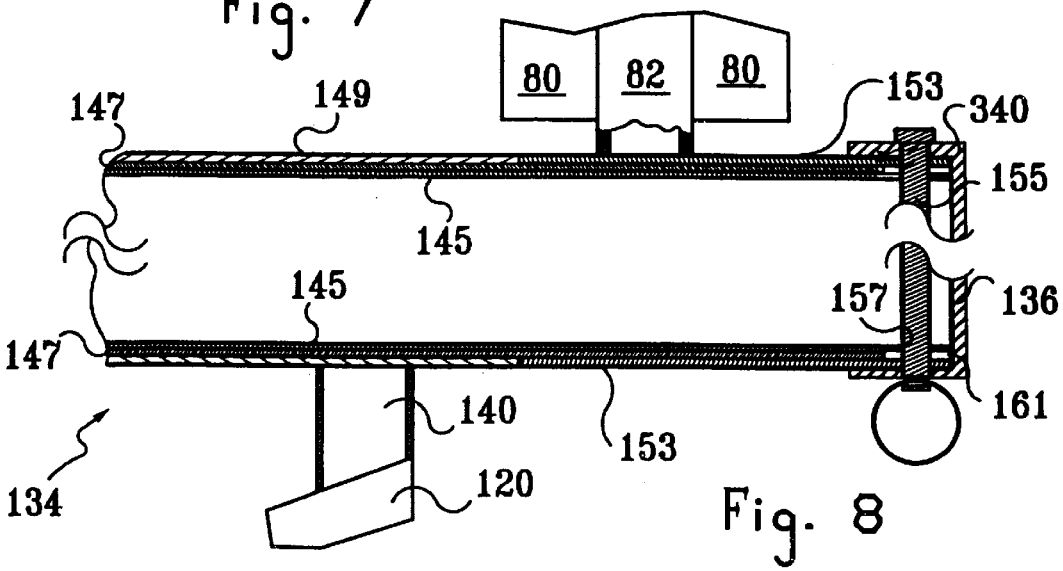
FIG. 8 is a fragmentary, partially cut away, cross sectional view of the back end of a hinge member of this invention.
Figure 15:
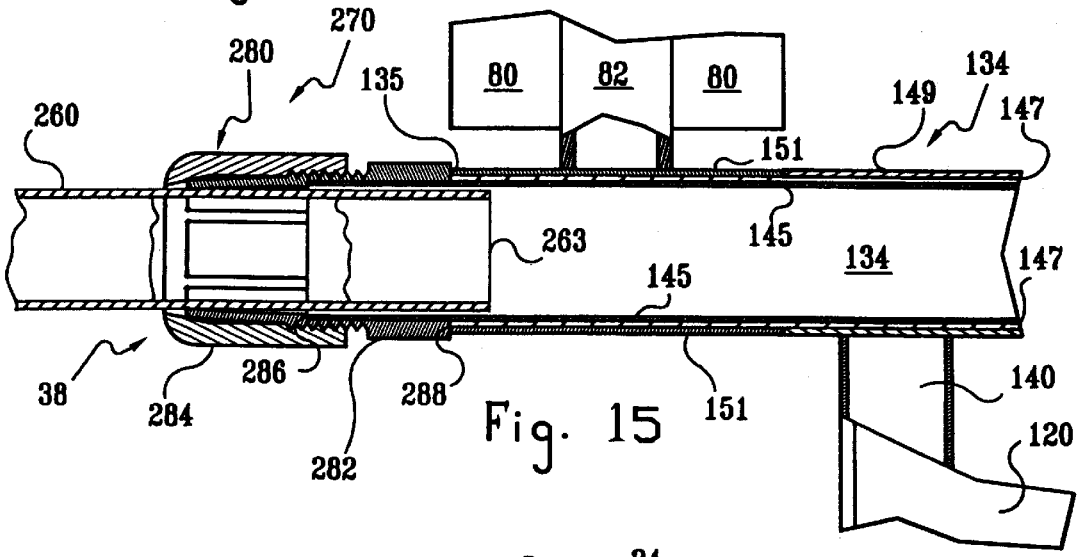
FIG. 15 is a fragmentary, partially cut away, cross sectional view of the front end of a hinge member of this invention with a foot rest assembly attached.

Referring to FIGS. 7, 8, and 15 each hinge assembly 134 may include a hinge pin 145, a bushing 147, at least one deck hinge member 149, first and second saddle hinge members 151, 153 associated with each saddle 70, and a clevis pin 155. In one embodiment of the invention, a tubular bushing 147 is inserted between a tubular hinge pin 145 and tubular deck 149 and saddle members 151, 153 respectively.

Tubular deck 149 and saddle hinge members 151, 153 of matching inner diameter are longitudinally aligned end to end. A continuous bushing 147 is inserted through a first saddle hinge member 151, a deck hinge member 149, and then a second saddle hinge member 153. A hinge pin 145 is inserted inside the tubular bushing 147. The aft ends of the second saddle hinge member 153 and the hinge pin 145 are flush with the back end 136 of the hinge assembly 134. The bushing 147 is continuous through the combined lengths of the hinge members 149, 151, 153 but stops short of the back end 136 of the hinge assembly 134. A clevis pin 155 (FIG. 8) is inserted in through hole 157 the back end 136 of the hinge assembly 134. Through hole 157 travels through the second saddle hinge member 153, the space 161 left between the bushing 147 and the back end 136 of the hinge assembly 134, and through the hinge pin 145.

The hinge assembly 134 allows some rotation of the saddles 70 and deck support 60 around the hinge assembly 134 during use. This arrangement is particularly advantageous in that the rotational degree of freedom created by the hinge assembly 134 reduces the bending moments at the attachment points of the saddle stiffeners 82 and transverse cross beams 139, 140, to the saddle hinge members 151, 153 and the deck hinge member, respectively.

When compared to a solid frame construction, a reduction in the bending moments normally imposed at these attachment locations correlates to a stress reduction factor proportional to the plan view distance from the pontoon 24 centerline to the hinge pin 145 centerline. This allows a greater distance between pontoon 24 centerline to pontoon 24 centerline to be achieved without overloading the mainframe. More widely spaced pontoons 24 result in a larger and more stable vessel. Stress reduction at the attachment points also allows cost reductions in material selection and manufacturing to be realized. The use of less expensive materials, thinner cross sections, and fewer welds are examples of cost reduction measures that may be implemented.

Figure 9:
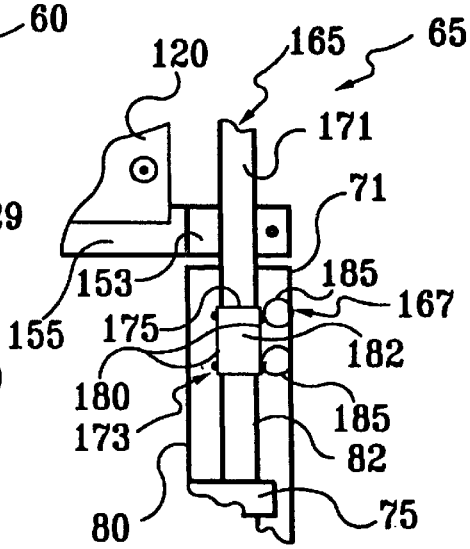
FIG. 9 is a fragmentary plan view of the section designated by the line 9—9 in FIG. 2, illustrating a portion of a saddle restraint system of the invention.

As illustrated in FIGS. 2 and 9, a saddle restrain system 65 includes a rigid bracing member 165 and a brace attachment mechanism 167. The bracing member 165 may include a strut 171 with a channel 173 at each end 175 of the strut 171. In one embodiment, channels 173 are butt welded on to each end 175 of the strut 171. The channels 173 each provide ears 180 which extend past the end 175 of the strut 171 to bracket a saddle stiffener 82 on assembling the strut 171 to the mainframe 22. One embodiment of a channel 173 of this invention provides a 3-sided channel 173 with a U-shaped cross section. The channel ears 180 are connected by a solid channel back 182. Use of a solid channel back 182 between the channel ears 180 constitutes a safety measure that eliminates a potential finger pinch point in the design.

The strut 171 spans the width of the back 129 of the deck support 60 and rests on the saddle stiffeners 82 near the inner ends 71 of transversely opposing saddles 70 of the two saddle assemblies 55. Channels 173 at each end of the strut 171 cradle a saddle stiffener 82 so that the channel back 182 rests on top of the stiffener 82. Two strut detent pins 185 are inserted through a pair of holes 187 bored through each of the channel ears 175 and saddle stiffeners 82.

During use, water movement causes load fluctuations through the pontoons 24 into the saddle assemblies 55. These load fluctuations cause the saddle assemblies 55 to move up or down with respect to the deck support 60. The saddle assemblies 55 rotate with the saddle hinge members 151, 153 and hinge pin 145 as the hinge pin 145 rotates in the bushing 147 and deck hinge member 149.

When the saddle assemblies 55 move upwardly with respect to the deck support 60, the rigid strut 171 is placed in compression. When the saddle assemblies 55 move downward with respect to the deck support 60, the strut 171 is placed in tension. Examples of circumstances urging the saddle assemblies 55 to rotate upward include placing a load on the deck support 60 or bouncing the pontoons 24 in rough water. Circumstances urging the saddle assemblies 55 to rotate downward include lifting the boat 12 to beach or transport it, and bumping into obstacles such as rocks in a river.

Figure 10:
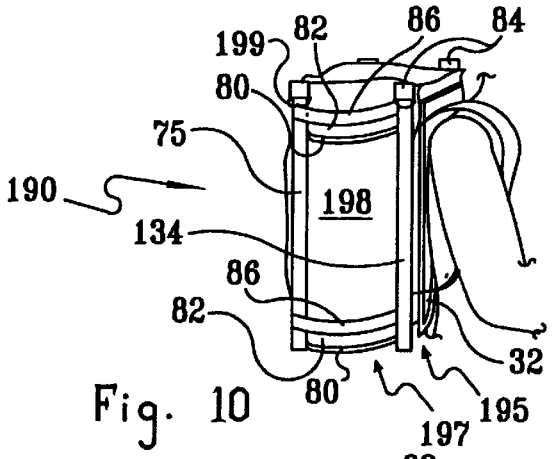
FIG. 10 is a partially cut away pictorial view of a mainframe of this invention collapsed into a back pack configuration.
Figure 11:
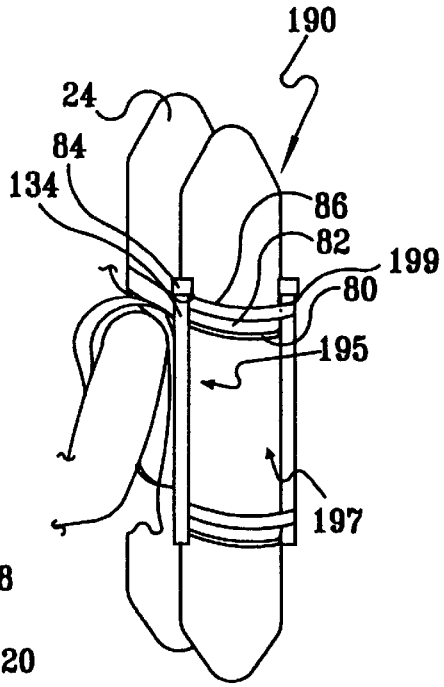
FIG. 11 is a pictorial view of an alternate back pack arrangement of a collapsed mainframe of this invention.

An embodiment of a mainframe 22 of this invention shown collapsed into a back pack frame configuration 190 is generally indicated in FIGS. 10 and 11. A back pack frame 190 of this invention includes a support frame 195 and a pack cargo cage 197. When collapsing the boat to achieve a back pack frame 190 the mainframe 22 is removed from the pontoons 24. The strut detent pins 185 are removed from the channels 173 and the strut 171 is removed from the back of the mainframe 22. The saddle assemblies 55 are then rotated under the deck support 60 until the end caps 84 of the respective saddle assemblies 55 meet. The pontoon straps 86 are then tightened to secure the resulting backpack cage 197.

The embodiment illustrated in FIG. 1 includes a stadium, or soft, seat 32 mounted on the seat platform 120. A soft seat 32 is generally preferred for use when backpacking the boat. The soft seat 32 remains mounted to the seat platform 120 as the mainframe is collapsed to form the back pack 190, as it functions as a cushion between the rigid seat platform 120 and the boater.

FIG. 10 shows one embodiment of a backpack configuration, including a pack sack 198 suspended within the cage 197. The pack sack 198 may be formed from a boat bag otherwise used to store the boat and accessories. Loops 199 may be attached to the pack sack 198 in position to neatly suspend the pack sack 198 in proper position within the cage 197. FIG. 11 illustrates an alternate embodiment. In some applications it may be preferable to use the back pack 190 to transport fully inflated pontoons 24.

Figure 12:
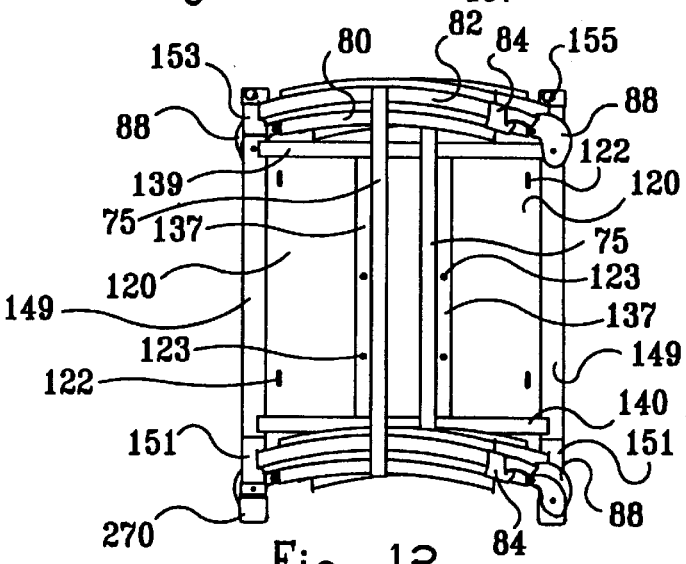
FIG. 12 is a front perspective view of a mainframe of this invention in fully collapsed position.

When collapsing the boat 20 to achieve optimal storage efficiency, the pontoons 24 and strut 171 are removed as for achieving the back pack configuration 190. As illustrated in FIG. 12, the saddle assemblies 55 are then individually rotated so that the end caps 84 of one of the saddle assemblies 55 rests against the deck support 60 before the other saddle assembly 55 is rotated to nest against the first assembly 55.

Figure 13:
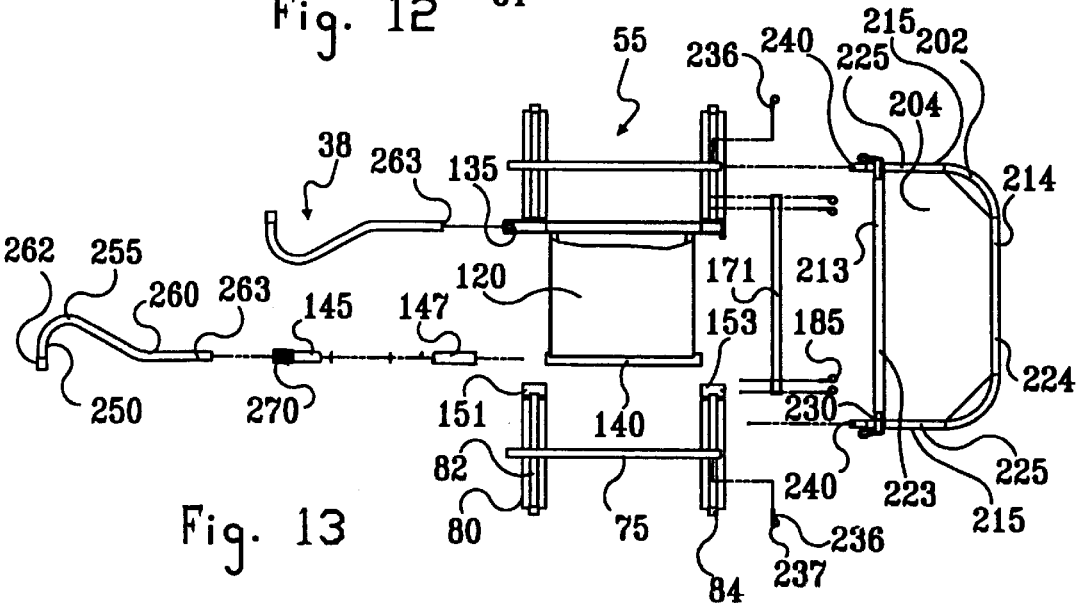
FIG. 13 is a partially cut away and partially exploded top plan view of the kick boat mainframe of FIG. 2 with rear cargo platform and foot rest attachments.
Figure 14:
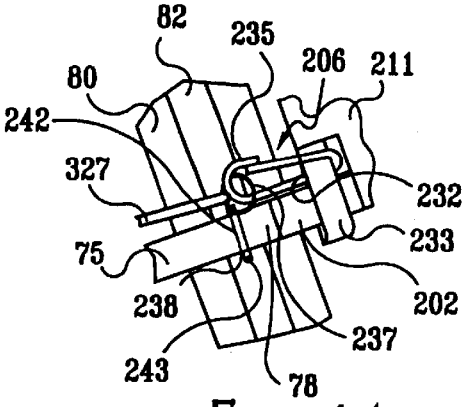
FIG. 14 is a fragmentary plan view, partially in phantom lines, of the section designated by the line 14—14 of FIG. 1.

As illustrated generally in FIGS. 1 and 3, and specifically in FIGS. 13 and 14, an improved cargo bay 34 of this invention may include a cargo frame 202, a cargo deck 204, and a cargo deck restraint system (generally 206 in FIG. 14.) In the illustrated embodiment, a soft cargo deck 204 includes a deck mesh (or canvas) which has a front 213, a back 214, and two parallel side 215 edges. Each of the deck edges 213, 214, 215 has a corresponding pocket 223, 224, 225 formed at and paralleling the corresponding edge. In the illustrated embodiment, a vinyl coated polyester deck mesh was heat welded to form the pockets 223, 224, 225.

A U-shaped cargo frame 202 may be inserted through a side pocket 225, then through the back pocket 224 and the remaining side pocket 225 to form the cargo deck 204. The cargo deck restraint system 206 includes a rigid stretcher bar 230 having through holes 232 at each end 233. In an alternate embodiment, through holes 232 are provided by the loop formed in a strap passed through a tubular stretcher bar 230 and around each side 215 of the cargo frame 202.

The stretcher bar 230 is inserted through the front cargo deck pocket 223. The restraint system 206 also includes cargo bay snap hooks 235 and cargo bay detent pins 236. The detent pins 236 include split rings 237 attached at one end. Snap hooks 235 are inserted in the through holes 232 at each end 233 of the stretcher bar 230 and fastened in the split rings 237. As the snap hooks 235 are advanced towards the split rings 237, the cargo deck 204 is placed in tension. Tension is maintained as long as the snap hooks 235 remain fastened, preventing the deck 204 from sagging when loaded.

In the illustrated embodiment, 1" square aluminum tubing frame construction is used throughout, except in the hinge assemblies 134. The H-frame 133 and cargo frame 202 are constructed with an 1/16" wall thickness, while the saddle stiffeners 82 and rails 75 are constructed with a 1/8" wall thickness to accommodate welding. Conventionally, the cargo bay frame 202 and rail 75 wall thicknesses are stepped down at their common joint, to allow the cargo frame 202 to slip into the rail 75 or similar frame member. Cargo frame 202 failures occur at the resulting stress riser, even in embodiments not incorporating the thicker wall structures of the illustrated saddle assembly 55 members.

Provision of a stress reducing coupler between the rail 75 and the cargo frame 202 solves the stress riser problem. The cargo bay frame 202 may be provided with discrete cargo frame couplers 240, or the coupling mechanism may be an integral part of the cargo frame 202 or mainframe 22. In the illustrated embodiment, FIG. 13, the couplers 240 are plugs structured at one end to fit inside a tubular cargo bay frame 202 and at the other to fit inside the back end 78 of a tubular rail 75.

Plastics are used to eliminate aluminum galling problems in the cargo bay joint. A relatively soft plastic (high density polyethylene for example) block ~7/8" square X ~2" long is machined to accept a relatively hard plastic peg of ~3/4" diameter. The round peg is inserted in the block (not shown), and the resulting coupler 240 is inserted in an open end of a cargo bay frame 202. A rivet is inserted through the cargo frame 202, block, and peg to permanently attach the coupler 240 to the frame 202. The round peg extends from the end of the cargo frame 202 and is inserted into a tubular rail 75, and pinned in place. The round cross section of the peg, and the relative compliance of the block material combine to eliminate stress risers in this joint area.

A through hole 242 is drilled through back end 78 of the rail 75 and the peg section of coupler 240 to accommodate the cargo bay detent pins 236. When the cargo bay 34 is assembled to the rail 75 the detent pin 236 is inserted in the through hole 242. The cargo deck 204 stretcher bar 230 is then pulled towards the back end 78 of the rail 75 and the snap hooks 235 secured in the split rings 237 of the detent pin 236.

A continuously and infinitely adjustable foot rest system 38 of this invention is illustrated in FIGS. 13 and 15. The system 38 includes a foot rest 250 and a leg support 255 which are mounted on an extension member 260 having front and back ends 262, 263 respectively. It also includes a foot rest adapter 270 for mounting a foot rest 250 to the mainframe and a locking mechanism 275.

A foot rest adapter 270 having open and closed positions is mounted in the front end 135 of each hinge assembly 134 to adjustably accept the back ends 263 of each extension member 260. A adapter 270 rigidly fixes the extension member 260 to the mainframe 22 when in closed position. In the illustrated embodiment, the adapters 270 are permanently mounted to the front ends 135 of each hinge assembly 134.

Referring to FIG. 15, a foot rest adapter 270 may be a collet assembly 280 having an externally threaded inner tubular member 282 and an internally threaded outer tubular member 284. A shoulder 286 in the ID of the inner member 282 registers with the front end of the hinge pin 145. An inner member 282 is permanently fastened to the hinge pin 145, in this case through adhesive bonding. A toughened urethane adhesive may be used to accomplish this bond for example.

When a hinge pin 145 is assembled in the bushing 147, saddle hinge 151, 153 and deck hinge 149 members, the hinge assembly 134 is pinned together with a clevis pin 155 through the back saddle hinge 153 and hinge pin 145. A permanently mounted foot rest adapter 270 loosely retains the front saddle hinge 151 and deck support hinge 149 members in position. The front of the hinge assembly 134 butts up against an aft face 288 of the inner member 282 of the collet assembly.

The back end 263 of a foot rest extension member 260 is inserted through the inner collet member 282 and into the hinge pin 145. An extension member 260 may be inserted into the tubular hinge pin 145 to whatever depth is required to match a boater's leg length, thereby providing infinite and continuous adjustment capability to the foot rest 250. The angle of the foot rest 250 may also be infinitely and continuously adjusted, by rotating the extension member 260 within the collet assembly 280. An extension member is fastened in place by rotating the outer collet member 284 to tighten the inner collet member 282 about the extension member 260.

In one embodiment of the kick boat, an extension member 260 is contiguously formed with a foot rest 250 and leg support 255. The foot rest 250 and leg support 255 may be provided by bends formed in the extension member 260 for example. Separately adjustable, discrete foot rests 250 and leg supports 255 are within contemplation of this invention.

Figure 16:
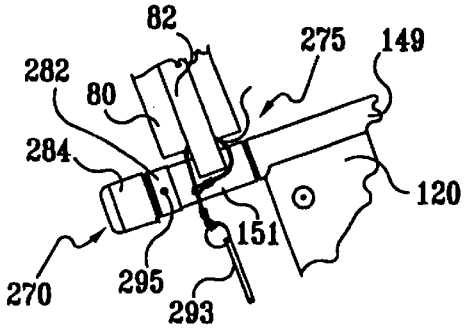
FIG. 16 is a fragmentary plan view of a foot rest locking mechanism and pin retention system of this invention.

A locking mechanism 275 is provided for extra security during rough usage or for use under fluctuating temperature conditions that might otherwise cause the collet assembly 280 to loosen and allow the foot rest 250 to slip. A locking mechanism 275 also provides increased convenience for primary users by allowing them to establish preset locking positions corresponding to their individual needs. As illustrated in FIG. 16, a locking mechanism 275 includes a detent pin 293 which is inserted in a predrilled hole 295 in the inner member 282 of the collet assembly 280, hinge pin 145, and foot rest extension member 260.

Figure 17:
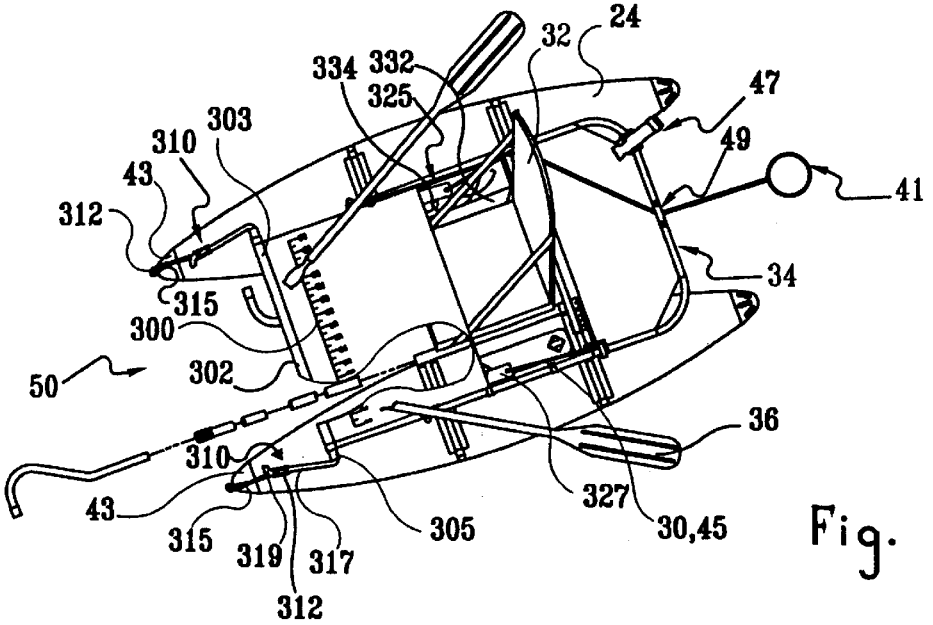
FIG. 17 is a partially cut away and partially exploded perspective view of an embodiment similar to that illustrated in FIG. 1, but with alternate accessories attached and with a stripping apron in deployed position.

Referring to FIG. 17, a full sized stripping apron assembly 50 includes a work surface 300 with a rigid and slightly elevated front end 302. A suitable work surface 300 may be fashioned from polymer mesh, and may include a heat welded or sewn pocket 303 formed along its front end 302. A rigid apron support 305 slipped through the pocket 303 eliminates any sagging at the front end 302 of the stripping apron.

Apron tether members 310 are attached to an apron support 305 and to D-rings 312 mounted in a nose cone 43. In the illustrated embodiment, the tether members 310 are fed through the interior of a tubular apron support 305 and each end is fastened off in a D-ring 312. Each end of a tether includes a quick release buckle 312 which opens to allow easy access to the seating area of a boat, without requiring disassembly of the stripping apron 50. Strap length adjustment mechanisms 319 attached to each buckle 312 provide infinite adjustment capability in longitudinally positioning the stripping apron 50 in front of the seating area of the boat 20.

Figure 18:
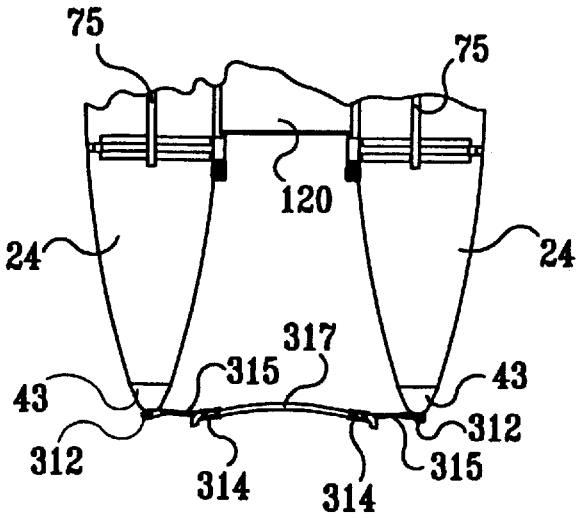
FIG. 18 is a partially cut away perspective view of a boat tether of this invention.

A quick release buckle 312 divides each end of a tether member 310 into boat tether strap 315 and apron support strap 317 sections. On release, the buckles 312 are arranged to provide intercooperating buckle parts at opposed boat tether strap 315 ends. As illustrated in FIG. 18, fastening the buckle parts on each boat tether strap 315 together forms a complete transverse boat tether that may be used independently of a stripping apron assembly 50.

Safety tabs 325 (FIG. 17) are used to provide a tensioning force to the apron working surface 300 to hold it taut against the apron support 305 and in proper position around a boater. In the illustrated embodiment, an easy release gripping tab 327 is attached at the free end of a stretch cord 329 which is fastened in a cargo bay detent pin 236 split ring 237 (FIG. 14). A cargo bay detent pin 236 may be mounted to the rail 75 to accommodate mounting a stripping apron assembly 50 with or without also mounting a cargo bay assembly 34. Hook and loop tape is an example of an appropriate easy release tab 327 material. A short section of loop material may be mounted at the back end 304 of the work surface 300 and a long section of corresponding hook material attached to a stretch cord. The impetus of a boater against the back end 304 of a stripping apron 50 on being ejected from a boat supplies sufficient force to safely release the tabs 327 from the stripping apron 50.

A stripping apron assembly 50 is illustrated in stowed position in FIG. 1. To stow the assembly 50, one buckle 312 is released. A soft working surface 300 is rolled onto a tubular apron support. Tether members 310 fed through the hollow tubular support do not become twisted as the working surface is rolled up. The released end of a apron support tether 317 may be tied to a strut 75 or cargo bay frame 202 member to restrain the rolled stripping apron assembly 50 in a stowed position along a side 125 of a seat platform 120.

Figure 19:
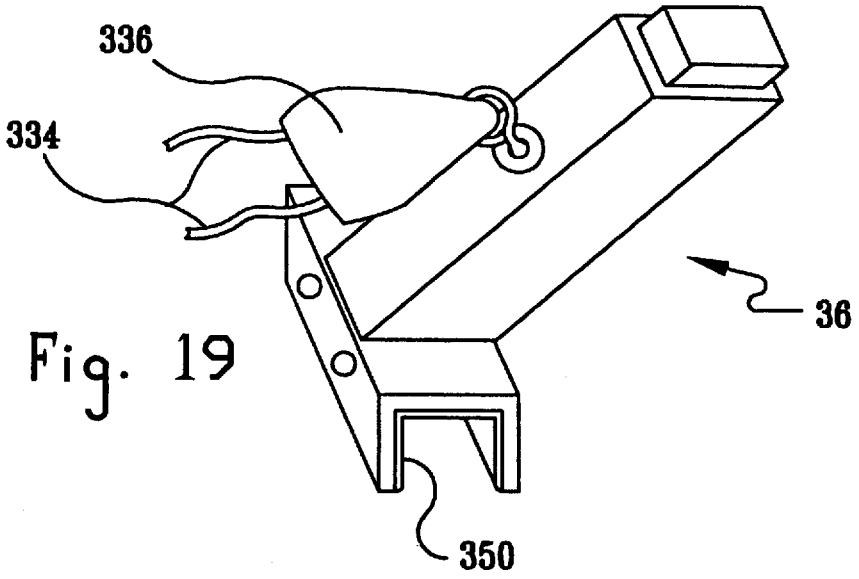
FIG. 19 is a partially cut away perspective view of an oar lock and part of an anchor pulley system of this invention.

A conventional anchor system 41 and cooperating anchor cleat 330 are illustrated in FIG. 1. An improved system such as that shown in FIG. 17 may be used alone, or with the cleat 330 for extra security. A rope basket 332 is positioned alongside a boater by attaching it to the raised rail 75. Rope 334 is fed in and out of the basket when retrieving or releasing an anchor system 41. Rope abrasion on pontoon and cargo bay surfaces is avoided through the use of a pulley system. A forward pulley 336 (FIGS. 5 and 19) mounted to the mainframe 22 forward of a boater's seated position accepts rope fed from an optional containment basket 332. An intermediate pulley 337, mounted to the under side of a strut 171 (FIG. 5), directs the rope away from pontoon 24 surfaces as it feeds through to a third pulley (not shown) mounted to a cargo bay frame 202 under the area designated for a motor mount 49 (FIGS. 1 and 17).

As a rope 334 feeds from the forward pulley 336 to the intermediate pulley 337, it travels downward, towards the plane of the water surface. From this position, the rope 334 must travel back up to meet the third pulley 338 under the cargo bay frame. An advantage of placing the intermediate pulley lower than the third pulley is that rope contact with and therefore abrasion of a cargo deck 204 is avoided.

Reference in this disclosure to details of certain specific embodiments is not intended to limit the scope of the appended claims which themselves recite those features regarded as important to the invention.

What is claimed is:

1. In a kick boat characterized by having a longitudinal axis, a pair of elongated pontoons oriented approximately parallel said longitudinal axis, and a support structure mounted to said pontoons through means structured and arranged to hold said pontoons in spaced parallel arrangement with a central platform of said support structure between said pontoons to provide support for a load, an improved such means comprising:

a connection system for mounting said support structure to said pontoons, said system comprising:

a plurality of saddle structures, each configured to distribute load across a substantial area of the upper surface of a pontoon, at least one such saddle structure being removably positioned atop each said pontoon; and linkage structure connecting each said saddle structure to said central platform, whereby the relative positions of said pontoons with respect to said platform are permitted to adjust in response to forces acting upon said pontoons.

2. An improvement according to claim 1, wherein said linkage structure includes a hinge assembly comprising:

a tubular deck frame hinge member with a central axis approximately parallel said longitudinal axis and positioned inboard a said pontoon in mounted condition, said deck frame hinge member further having an open terminal end;

a tubular saddle hinge member with an open terminal end juxtaposed to said terminal end of said deck frame hinge member at a pivot plane such that a central axis of said saddle hinge member is approximately congruent with said central axis of said deck frame member; and pin structure extending through said pivot plane to register with the interiors of said deck frame hinge member and said saddle hinge member, whereby to permit pivoting movement at said plane.

3. An improvement according to claim 2, wherein said hinge assembly further includes a tubular bushing inserted through the hollow interiors of said deck frame hinge member and said saddle hinge member and, said hinge pin is inserted through the hollow interior of said tubular bushing.

4. An improvement according to claim 1, wherein said support structure comprises:

a mainframe having first and second side members parallel said longitudinal axis;

first and second saddle assemblies, each including a said saddle structure, and lock down mechanisms by which said pontoons are firmly attached through said saddle assemblies to said mainframe such that said pontoons are held approximately parallel each other and parallel said longitudinal axis; and a deck frame assembly located between and affixed to said saddle assemblies, said deck frame serving as a rigid spacer between said saddle assemblies.

5. An improvement according to claim 4, wherein said deck frame assembly comprises a platform and said first and second side members, each said side member connecting to a respective said flexible linkage structure.

6. An improvement according to claim 5, wherein each said linkage structure comprises:

a tubular deck frame hinge member with a central axis approximately parallel said longitudinal axis and positioned inboard a said pontoon in mounted condition, said deck frame hinge member further having an open terminal end;

a tubular saddle hinge member with an open terminal end juxtaposed to said terminal end of said deck frame hinge member at a pivot plane such that a central axis of said saddle hinge member is approximately congruent with said central axis of said deck frame member; and pin structure extending through said pivot plane to register with the interiors of said deck frame hinge member and said saddle hinge member, whereby to permit pivoting movement at said plane.

7. An improvement according to claim 6, wherein said saddle assemblies are structured and arranged to permit pivotal movement approximately 180 degrees around said hinge pins to a stacked collapsed arrangement atop said deck frame assembly.

8. An improvement according to claim 7, wherein said saddle assemblies are configured to form, together with said deck frame assembly, a back pack frame when said saddle assemblies are pivoted partially towards said stacked collapsed arrangement.

9. In a kick boat characterized by having a longitudinal axis, a pair of elongated pontoons oriented approximately parallel said longitudinal axis, and a support structure mounted to said pontoons through means structured and arranged to hold said pontoons in spaced parallel arrangement with a central platform of said support structure between said pontoons to provide support for a load, said boat having forward and aft ends, an improved such means comprising:

a mainframe having first and second side members approximately parallel said longitudinal axis, transverse support structure connecting said first and second side members and a seating area forward of said transverse support structure; and first and second foot rest assemblies, each having a foot support portion carried at the distal end of and approximately transverse a longitudinal support member;

the longitudinal support members of each said foot rest assembly being connected to said mainframe through respective adjustable mounting mechanisms structured and arranged to provide an adjustable distance between said foot supports and said seating area.

10. An improvement according to claim 9, wherein said adjustable mounting mechanisms are structured and arranged to permit adjustment of the rotational attitude with respect to horizontal of each said foot support.

11. An improvement according to claim 9, wherein each said adjustable mounting mechanism comprises a tubular collet assembly mounted on said mainframe, said collet assembly being selectively adjustable between loosened and tightened conditions, the length of a said longitudinal support member being adjustable by sliding said longitudinal support member within said collet assembly and the rotational attitude of a said foot rest being adjustable by rotating said longitudinal support member within said collet assembly.

12. An improvement according to claim 9, further including a connection system for mounting said support structure to said pontoons, said system comprising:

a plurality of saddle structures, each configured to distribute load across a substantial area of the upper surface of one of said pontoons, at least one such saddle structure being positioned atop each said pontoon; and linkage structure connecting each said saddle structure to said central platform, whereby the relative positions of said pontoons with respect to said platform are permitted to adjust in response to forces acting upon said pontoons.

13. An improvement according to claim 12, wherein said linkage structure includes a hinge assembly comprising:

a tubular deck frame hinge member with a central axis approximately parallel said longitudinal axis and positioned inboard a said pontoon in mounted condition, said deck frame hinge member further having an open terminal end;

a tubular saddle hinge member with an open terminal end juxtaposed to said terminal end of said deck frame hinge member at a pivot plane such that a central axis of said saddle hinge member is approximately congruent with said central axis of said deck frame member; and pin structure extending through said pivot plane to register with the interiors of said deck frame hinge member and said saddle hinge member, whereby to permit pivoting movement at said plane.

14. An improvement according to claim 13, wherein:

said first and second side members comprise said flexible linkage structure connecting each said saddle structure to said central platform; and the longitudinal support member of each said foot rest assembly is connected to said mainframe through a respective adjustable mounting mechanism associated with said linkage structure.

15. An improvement according to claim 14, wherein said linkage structure includes a hinge assembly comprising:

a tubular deck frame hinge member with a central axis approximately parallel said longitudinal axis and positioned inboard a said pontoon in mounted condition, said deck frame hinge member further having an open terminal end;

a tubular saddle hinge member with an open terminal end juxtaposed to said terminal end of said deck frame hinge member at a pivot plane such that a central axis of said saddle hinge member is approximately congruent with said central axis of said deck frame member; and pin structure extending through said pivot plane to register with the interiors of said deck frame hinge member and said saddle hinge member, whereby to permit pivoting movement at said plane.

16. An improvement according to claim 15, wherein said hinge assembly further includes a tubular bushing inserted through the hollow interiors of said deck frame hinge member and said saddle hinge member and, said hinge pin is inserted through the hollow interior of said tubular bushing.

17. An improvement according to claim 14 wherein each said adjustable mounting mechanism comprises a tubular collet assembly mounted on said mainframe in operable association with a respective said first and second side members, said collet assembly being selectively adjustable between loosened and tightened conditions, the length of a said longitudinal support member being adjustable by sliding said longitudinal support member within said collet assembly and the rotational attitude of a said foot rest being adjustable by rotating said longitudinal support member within said collet assembly.

18. An improvement according to claim 17, wherein said linkage structure includes a hinge assembly comprising:

a tubular deck frame hinge member with a central axis approximately parallel said longitudinal axis and positioned inboard a said pontoon in mounted condition, said deck frame hinge member further having an open terminal end;

a tubular saddle hinge member with an open terminal end juxtaposed to said terminal end of said deck frame hinge member at a pivot plane such that a central axis of said saddle hinge member is approximately congruent with said central axis of said deck frame member; and hollow pin structure extending through said pivot plane to register with the interiors of said deck frame hinge member and said saddle hinge member, whereby to permit pivoting movement at said plane; and said collet assembly is mounted to a second open terminal end of said saddle hinge member such that a said longitudinal support member of a said foot rest assembly may be inserted through said hollow pin structure into the interiors of said saddle hinge member and said deck frame hinge member.

19. An improvement according to claim 18, wherein said hinge assembly further includes a tubular bushing inserted through the hollow interiors of said deck frame hinge member and said saddle hinge member and, said hinge pin is inserted through the hollow interior of said tubular bushing.

20. An improvement according to claim 19 wherein said longitudinal support is configured to provide support to the leg of an individual seated on said seating area with the foot of said individual positioned against said foot support.

21. In a kick boat characterized by having a longitudinal axis, a pair of elongated pontoons oriented approximately parallel said longitudinal axis, and a support structure mounted to said pontoons through means structured and arranged to hold said pontoons in spaced parallel arrangement with a central platform of said support structure between said pontoons to provide support for a load, said boat having forward and aft ends, an improved such means comprising flexible linkage structure connecting each said pontoon to said central platform, whereby the relative positions of said pontoons with respect to said platform are permitted to adjust in response to forces acting upon said pontoons.

22. An improvement according to claim 21, wherein said linkage structure includes a hinge assembly comprising:

a tubular deck frame hinge member with a central axis approximately parallel said longitudinal axis and positioned inboard a said pontoon in mounted condition, said deck frame hinge member further having an open terminal end;

a tubular saddle hinge member with an open terminal end juxtaposed to said terminal end of said deck frame hinge member at a pivot plane such that a central axis of said saddle hinge member is approximately congruent with said central axis of said deck frame member; and pin structure extending through said pivot plane to register with the interiors of said deck frame hinge member and said saddle hinge member, whereby to permit pivoting movement at said plane.

23. An improvement according to claim 22, wherein said hinge assembly further includes a tubular bushing inserted through the hollow interiors of said deck frame hinge member and said saddle hinge member and, said hinge pin is inserted through the hollow interior of said tubular bushing.

24. An improvement according to claim 23, further comprising:

a mainframe having first and second side members approximately parallel said longitudinal axis, transverse support structure connecting said first and second side members and a seating area forward of said transverse support structure; and first and second foot rest assemblies, each having a foot support portion carried at the distal end of and approximately transverse a longitudinal support member;

each said longitudinal support member being connected to said mainframe through respective adjustable mounting mechanisms structured and arranged to provide an adjustable distance between said foot supports and said seating area.

25. An improvement according to claim 24, wherein said adjustable mounting mechanisms are structured and arranged to permit adjustment of the rotational attitude with respect to horizontal of each said foot support.

26. An improvement according to claim 24, wherein each said adjustable mounting mechanism comprises a tubular collet assembly mounted on said mainframe, said collet assembly being selectively adjustable between loosened and tightened conditions, the length of a said longitudinal support member being adjustable by sliding said longitudinal support member within said collet assembly and the rotational attitude of a said foot rest being adjustable by rotating said longitudinal support member within said collet assembly.

27. An improvement according to claim 26, wherein said pin is hollow and extends through said pivot plane to register with the interiors of said deck frame hinge member and said saddle hinge member, whereby to permit pivoting movement at said plane; and said collet assembly is mounted to a second open terminal end of said saddle hinge member such that a said longitudinal support member of a said foot rest assembly may be inserted through said hollow pin structure into the interiors of said saddle hinge member and said deck frame hinge member.

28. An improvement according to claim 27, wherein said hinge assembly further includes a tubular bushing inserted through the hollow interiors of said deck frame hinge member and said saddle hinge member and, said hinge pin is inserted through the hollow interior of said tubular bushing.

29. An improvement according to claim 28, wherein each said longitudinal support is configured to provide support to the leg of an individual seated on said seating area with the foot of said individual positioned against said foot support.

30. In a kick boat characterized by having a longitudinal axis and forward and aft ends, first and second elongated pontoons oriented approximately parallel said longitudinal axis, and a support structure mounted to said pontoons through means structured and arranged to hold said pontoons in spaced parallel arrangement with a central platform of said support structure between said pontoons to provide support for a load, the improvement comprising:

a connection system for mounting said support structure to said first and second pontoons, said system comprising:

a plurality of saddle structures, each configured to distribute load across the upper surface of a said pontoon, at least one such saddle structure being positioned atop each of said first and second pontoons;

linkage structure connecting each said saddle structure to said central platform, whereby the relative positions of said pontoons with respect to said platform are permitted to adjust in response to forces acting upon said pontoons; and a rigid bracing member having first and second ends, said bracing member oriented transverse said longitudinal axis, said first end being attached to a first said saddle structure atop said first pontoon and said second end being attached to a second said saddle structure atop said second pontoon, whereby said bracing member is exclusively compressively loaded under conditions wherein a downward load is placed on top of said support structure and is counterbalanced by the upward force of water against said pontoons, said forces acting through said flexible linkage structure, and said bracing member being exclusively tension loaded when said support structure experiences upward loads sufficient to exceed the downward force of the weight of said support structure plus any load resting on said support structure.

31. An improvement according to claim 30, wherein said connection system includes a single said bracing member, said bracing member being located near the aft end of said central platform whereby entry into and egress from said central platform by way of said forward end of said kick boat is unimpeded.

32. A kick boat, comprising:

a pair of elongated pontoons oriented approximately parallel a longitudinal axis;

a support structure having a central platform mounted to said pontoons through respective hinge mechanisms, each said mechanism:

including a first member connected to said platform and a second member connected to a respective said pontoon; and being structured and arranged to permit pivoting of said second member with respect to said first member about an axis approximately parallel said longitudinal axis; and compressive strut structure positioned to link said hinge mechanisms, whereby to react to compressive forces induced by said pontoons floating on water.

33. A kick boat, comprising:

a pair of elongated pontoons oriented approximately parallel a longitudinal axis and each having fore and aft ends;

a support structure having a central platform located inboard with respect to said pontoons, said central platform having a forward edge;

mounting means structured and arranged to connect said central platform to said pontoons and to hold said pontoons in spaced parallel arrangement with said central platform between said pontoons, whereby to provide support for a load, said mounting means comprising:

a first pair of saddle structures mounted with one saddle structure on each of said pontoons at an aft location;

a second pair of saddle structures mounted with one saddle structure on each of said pontoons at a fore location;

first and second, approximately parallel rigid rails connecting the respective saddle structures of said first pair to the respective saddle structures of said second pair; and first and second linkage structures inboard from said first and second rigid rails, respectively, each said linkage structure being structured and arranged to permit pivoting movement of the saddle structures associated with a said rail around an axis approximately parallel and inboard said rail; and a strut member oriented transverse said longitudinal axis and located near the aft end of said central platform, said strut member connecting the aft said pair of saddle structures.

34. A kick boat according to claim 33, wherein said mounting means includes a single said strut member, and said forward edge of said central platform constitutes the forward most support structure located between said pontoons, thereby providing unimpeded entry into and egress from said central platform.

35. A kick boat according to claim 33, wherein each said saddle structure further comprises:

a rigid saddle stiffener, having inboard and outboard ends;

a saddle isolation unit carried by said saddle stiffener and including a bearing surface positioned to ride against the surface of a pontoon and having a surface area substantially greater than the contact area of said saddle stiffener, said saddle stiffener being attached to said isolation unit such that said saddle stiffener is isolated from the surface of said pontoon; and a pontoon strap system attached to said inboard and outboard ends, constituting means for attaching said saddle structure to said pontoon.

* * * * *